United States Patent [19]

Verma et al.

[11] Patent Number: 4,514,192

[45] Date of Patent: Apr. 30, 1985

[54] SILICON OXIDE LAPPING COATINGS

[75] Inventors: Surendra K. Verma, Carmel; George A. Kim, Indianapolis, both of Ind.

[73] Assignee: RCA Corporation, Princeton, N.J.

[21] Appl. No.: 402,379

[22] Filed: Jul. 27, 1982

[51] Int. Cl.[3] ..... B24B 1/00

[52] U.S. Cl. ..... 51/295; 51/209 DL; 51/298; 51/308; 427/39; 427/40

[58] Field of Search ..... 51/298, 308, 209 DL, 51/295; 427/39, 40

[56] References Cited

U.S. PATENT DOCUMENTS

| | | | |
|---|---|---|---|
| 2,947,617 | 8/1960 | Wentorf, Jr. | 51/307 |
| 2,973,246 | 2/1961 | Harman et al. | 23/182 |
| 3,986,847 | 10/1976 | Balson | 51/308 |
| 4,104,832 | 8/1978 | Keizer | 51/281 R |
| 4,248,606 | 2/1981 | Bovenkerk et al. | 51/307 |
| 4,268,276 | 5/1981 | Bovenkerk | 51/295 |
| 4,328,646 | 5/1982 | Kaganowicz | 51/281 R |
| 4,339,471 | 7/1982 | Kaganowicz et al. | 427/39 |
| 4,352,836 | 10/1982 | Robinson et al. | 427/39 |
| 4,355,052 | 10/1982 | Kaganowicz et al. | 427/39 |
| 4,361,595 | 11/1982 | Kaganowicz et al. | 427/39 |

*Primary Examiner*—James Derrington

*Attorney, Agent, or Firm*—Birgit E. Morris; Theodore R. Furman

[57] ABSTRACT

Enhanced micromachining rates are observed when lapping discs with standard $SiO_x$ lapping coatings are doped with trivalent or pentavalent additives, such as boron or phosphorous. Doping can be accomplished by subjecting the $SiO_x$ material to a "post glow", i.e., an argon plasma in the presence of a source of the dopant.

11 Claims, 1 Drawing Figure

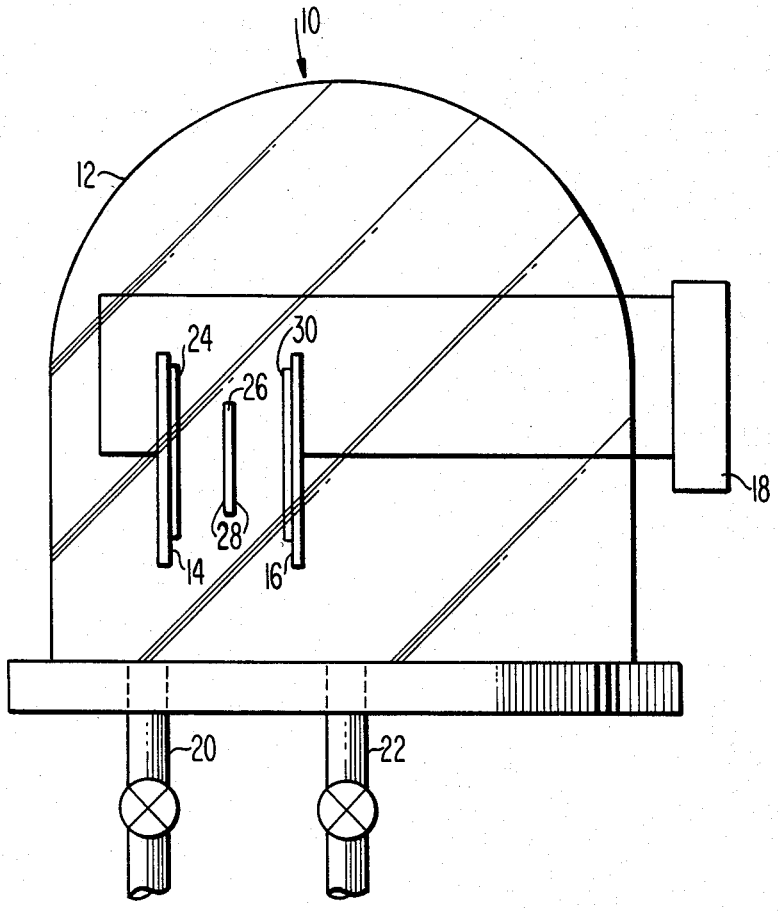
10
12
24
30
26
18
28
14
16
20
22

SILICON OXIDE LAPPING COATINGS

BACKGROUND OF THE INVENTION

Kaganowicz, in U.S. Pat. No. 4,328,646, describes a method for preparing a silicon oxide ($SiO_x$) coating on a substrate which includes subjecting silane and a gaseous, oxygen-containing compound selected from the group consisting of $N_2O$, $H_2O$ and $CO_2$ to a glow discharge. Kaganowicz et al, in U.S. Pat. No. 4,355,052 entitled "Method for Obtaining an Abrasive Coating", disclose a method in which subjecting $SiH_4$ and $N_2O$ to a glow discharge for the purpose of depositing $SiO_x$ onto a substrate includes the additional step of adjusting the refractive index and thickness of the $SiO_x$ coating by means of the glow discharge deposition process parameters so as to maximize the micromachining efficiency of the $SiO_x$ coating.

The resulting silicon oxide coatings can effectively lap hard materials such as diamone. One application of the silicon oxide coatings is in the shaping of a diamond playback stylus for use with capacitive information disc records. A method for producing suitable styli was described in Keizer in U.S. Pat. No. 4,104,832. An improved coating capable of decreasing the micromachining time to lap such styli would be useful for high volume production.

SUMMARY OF THE INVENTION

It has been found that when $SiO_x$ coating materials used in micromachining are doped with certain trivalent or pentavalent additives such as boron or phosphorous, the efficiency of micromachining is greatly enhanced. Doping can be accomplished by subjecting the $SiO_x$ material to a glow discharge in the presence of a source of the desired dopant.

BRIEF DESCRIPTION OF THE DRAWING

The FIGURE is a cross-sectional view of an apparatus suitable for doping lapping films according to the present invention.

DETAILED DESCRIPTION OF THE INVENTION

The $SiO_x$ lapping material of the present invention can be doped by any convenient method known in the art. A preferred method is subjecting the already deposited $SiO_x$ film to a "post glow", that is, a post treatment wherein the $SiO_x$ film is exposed to an argon plasma in the presence of a dopant source. This process allows doping of the film to dopant levels higher than those attainable by co-deposition of $SiO_x$ and the dopant. The limitations on doping levels achieved by co-deposition are due to drastically different deposition rates between the $SiO_x$ and the dopants employed to improve micromachining. Multiple "post glows" may be utilized to increase the doping level sufficiently to enhance the micromachining rate of the resultant lapping material without subjecting the substrate material to the detrimental overheating which is possible from a single, extended "post glow".

Although the exact mechanism for the micromachining capabilities of the $SiO_x$ material is not known, it has been found that when trivalent or pentavalent dopants, such as boron or phosphorous, are added to the $SiO_x$ in sufficient amounts, the micromachining efficiency of the doped layer is substantially improved.

A glow discharge apparatus suitable for preparing the doped $SiO_x$ material is shown in the FIGURE generally as 10. The glow discharge apparatus includes a vacuum chamber 12. In the vacuum chamber 12 are two electrodes 14 and 16 which can be a screen, coil or plate of material that is a good electrical conductor and does not readily sputter, such as aluminum. The electrodes 14 and 16 are connected to a power supply 18, which may be DC or AC, to produce a voltage potential. An outlet 20 from the vacuum chamber 12 allows for evacuation of the system and is connected to a pumping station, not shown. An inlet 22 is connected to a gas bleed system, not shown, for adding the gas necessary for the plasma. Sources of the dopant 24 and 30 can be attached in solid form to the electrodes 14 and 16 in any convenient manner. The dopant sources 24 and 30 are typically in the form of a slab or disc and can be of a material such as boron nitride for doping boron into the $SiO_x$ film, or silicon hypophosphate for adding phosphorous.

In carrying out the process, a substrate 26 with an $SiO_x$ layer 28 to be doped thereon, is placed between the electrodes 14 and 16, which have the dopant sources 24 and 30 thereon. The electrodes 14 and 16 are typically maintained about 5 to 10 centimeters apart. The vacuum chamber 12 is then evacuated through the outlet 20 to a pressure of about $5\times10^{-5}$ torr. Argon, $N_2O$ or other inert gas is added through the inlet 22 to the desired pressure, preferably $4.5\times10^{-2}$ torr.

In order to begin the doping of the $SiO_x$ layer 28, a glow discharge is initiated between the electrodes 14 and 16 by energizing the power supply 18, preferably to about 300 watts. R.F. High power dopings of 1000 watts do put more boron into the $SiO_x$ layer in a single treatment, but create a lack of uniformity of doping, decomposition of the $SiO_x$ film and degradation of the substrate.

A low melting point substrate 26 such as a vinyl chloride homopolymer or copolymer disc may warp when heated above about 50° C. Thus, when temperatures in this vicinity are reached, the system is shut down and allowed to cool. If a single "post-glow" has not sufficiently doped the $SiO_x$ layer 28 to the desired level, the process can be repeated as many times as are necessary.

An application of the present doped $SiO_x$ lapping material is for shaping a diamond playback stylus for use with a capacitive information disc record. A method for producing suitable styli is described by Keizer in U.S. Pat. No. 4,104,832. The tip of the stylus is shaped by means of a deep, coarse-pitched groove in a disc coated with a doped $SiO_x$ layer according to the present invention.

The invention will be further illustrated by the following Examples, but is not meant to be limited by the details described therein.

EXAMPLE 1

A vinyl chloride homopolymer lapping disc A, 30.5 centimeters in diameter, having a coarse-pitched spiral groove about 4.5 micrometers deep in a surface thereof and coated with a 500 angstrom thick layer of chromium and about a 1200 angstrom thick layer of $SiO_x$ was placed in a bell jar as described in the FIGURE which was kthen evacuated to $5\times10^{-5}$ torr. Argon was added to a partial pressure of $4.5\times10^{-2}$ torr using a flow rate of 100 standard cubic centimeters per minute (SCCM).

The lapping disc A was rotated at a rate of 50 revolutions per minute (rpm) between two 15 centimeter by 15 centimeter aluminum electrodes. These electrodes covered a strip approximately 11 centimeters wide on the disc. Attached to the front faces of the electrodes were slabs of boron nitride. To create a glow between the electrodes, the power source was energized to 300 watts. Doping of the $SiO_x$ layer was continued for 150 seconds. Only one "post glow " was employed in this test.

Two other substantially identical lapping discs, B and C, were also given single "post glows", independently, as described above. The micromachining rates of lapping discs A, B and C as well as for a Control Disc (standard $SiO_x$ with no "post glow") were checked by observing the lapping characteristics for each disc in machining 5 styli. Table I below summarizes the results. The dimensions of the styli were carefully measured before and after lapping to determine the volume of material removed from each in cubic micrometers. AVG. VOL. is the average amount of material removed from the 5 styli lapped, AVG.VOL./SEC. is the cubic micrometers removed per second and KLTime is the estimated keel lap time (in seconds) necessary to lap the styli to the desired dimension.

TABLE I

| Lapping Disc | AVG. VOL. | AVG. VOL./SEC. | KLTime |
|---|---|---|---|
| Control Disc | 34.88 | .88 | 30.67 |
| A | 46.18 | 1.32 | 20.46 |
| B | 39.74 | 1.25 | 21.53 |
| C | 47.33 | 1.57 | 17.15 |

These results show an improvement in the lapping rates of the "post glowed" discs compared to the Control Disc, and a relatively good reproducibility from one lapping disc to the next.

EXAMPLE 2

This example shows the effects of multiple "post glows" to increase the doping levels and further enhance the micromachining rates for $SiO_x$ coated lapping discs. Four substantially identical lapping discs were coated with the standard $SiO_x$ lapping layer. One of these discs received no "post glow" and served as the CONTROL. Disc #1 was subjected to a single, 150 sec. "post glow"; Disc #2 was subjected to two consecutive, 150 second "post glows" and Disc #3 was subjected to three consecutive, 150 second "post glows". TABLE II below summarizes lapping results of these discs on two samples each where VOL./SEC. is the volume of material in cubic micrometers removed (from each stylus) per second, KLTime is the estimated keel lap time to lap a stylus to the desired dimension and STYLI/DISC shows the estimated number of styli able to be lapped by each disc.

TABLE II

| Lapping Disc | VOL./SEC. | KLTime | STYLI/DISC |
|---|---|---|---|
| Control Disc | .63–.88 | 35 sec. | 40 |
| Disc #1 | 1.33–1.99 | 16 sec. | 87 |
| Disc #2 | 1.58–1.68 | 16 sec. | 86 |
| Disc #3 | 2.02–2.74 | 11 sec. | 126 |

The increasing improvement can be traced as the number of "post glows" (and thereby the amount of boron doping) increases, by observing the estimated keel lap time as it diminishes from 35 seconds with no "post glow" down to 11 seconds with three "post glows".

EXAMPLE 3

This example illustrates the micromachining characteristics of the same four discs of Example 2 above, after they have been subjected to a stress environment of 85 percent relative humidity for 24 hours. TABLE III below summarizes the lapping data.

TABLE III

| Lapping Disc | VOL./SEC. | KLTime | STYLI/DISC |
|---|---|---|---|
| Control Disc | .56–.70 | 43 sec. | 33 |
| Disc #1 | .74–.83 | 34 sec. | 41 |
| Disc #2 | 1.24–1.62 | 18 sec. | 75 |
| Disc #3 | 1.23–1.26 | 22 sec. | 65 |

EXAMPLE 4

In this example, the similar enhancing effects of phosphorous doping are illustrated. A lapping disc coated with $SiO_x$ was subjected to a "post glow" essentially as in Example 1 except, instead of boron nitride slabs, silicon hypophosphate slabs were employed as a source of phosphorous. This lapping disc received a single, 150 second "post glow" as per the process parameters described in Example 1. This "P" disc was compared to a Control with regard to micromachining capabilities. Each lapping disc was used to lap 11 styli. The length of the keel tip for each stylus was measured (this is a direct function of the amount of material removed by lapping). The results are summarized in Table IV below where AVG.LENGTH, LAPPING TIME and RATE, which is described as the average length per second, are shown.

TABLE IV

| LAPPING DISC | AVG. LENGTH | LAPPING TIME | RATE |
|---|---|---|---|
| Control | 5.1 μm | 35 sec. | .15 μm/sec. |
| "P" Disc | 3.9 μm | 15 sec. | .26 μm/sec. |

The lapping disc subjected to a single phosphorous "post glow" exhibited an approximately 80 percent increase in lapping efficiency.

What is claimed is:

1. In a lapping disc comprising a substrate and an $SiO_x$ lapping coating thereon, where $1 \leqq x \leqq 2$, the improvement wherein the $SiO_x$ coating contains a dopant selected from the group consisting of boron and phosphorous in an amount sufficient to enhance the micromachining abilities of said coating.

2. A lapping disc in accordance with claim 1 wherein the dopant is boron.

3. A lapping disc in accordance with claim 1 wherein the dopant is phosphorous.

4. A lapping disc in accordance with claim 1 wherein the substrate is a homopolymer or copolymer of vinyl chloride.

5. A lapping disc in accordance with claims 1 and 4 wherein a metal layer is interposed between the substrate and the $SiO_x$ layer.

6. In a method for preparing an abrasive $SiO_x$ coating wherein $1 \leqq x \leqq 2$, comprising subjecting $SiH_4$ and $N_2O$ or $CO_2$ or $H_2O$ to a glow discharge and depositing the $SiO_x$ product onto a substrate;

the improvement comprising the additional step of subjecting the $SiO_x$ coated substrate to a post-glow in the presence of a source of a dopant selected from the group consisting of boron and phosphorous in an amount sufficient to increase the abrasiveness of the $SiO_x$ coating.

7. The method of claim 6 wherein the dopant is boron.

8. The method of claim 7 wherein the coating is provided by post glowing the coating in the presence of boron nitride.

9. The method of claim 6 wherein the dopant is phosphorous.

10. The method of claim 9 wherein the coating is provided by post glowing the coating in the presence of silicon hypophosphate.

11. The method of claim 6 wherein the substrate is a homopolymer or copolymer of vinyl chloride.

* * * * *